US008915265B2

(12) United States Patent
Hebblethwaite

(10) Patent No.: US 8,915,265 B2
(45) Date of Patent: Dec. 23, 2014

(54) DOUBLE WALLED TANKS WITH INTERNAL CONTAINMENT CHAMBERS

(71) Applicant: Enviro Vault Inc., Union Bay (CA)

(72) Inventor: Russ Hebblethwaite, Union Bay (CA)

(73) Assignee: Envirovault Corporation, Calgary, Alberta (CA)

( * ) Notice: Subject to any disclaimer, the term of this patent is extended or adjusted under 35 U.S.C. 154(b) by 48 days.

(21) Appl. No.: 13/839,776

(22) Filed: Mar. 15, 2013

(65) Prior Publication Data

US 2013/0248018 A1 Sep. 26, 2013

Related U.S. Application Data

(63) Continuation-in-part of application No. 12/887,151, filed on Sep. 21, 2010, now Pat. No. 8,418,718.

(30) Foreign Application Priority Data

Sep. 22, 2009 (CA) ..... 2679790
Oct. 14, 2009 (CA) ..... 2682651

(51) Int. Cl.

| | |
|---|---|
| ***B65D 88/54*** | (2006.01) |
| ***B65D 90/10*** | (2006.01) |
| ***B67D 7/78*** | (2010.01) |
| ***B65D 90/26*** | (2006.01) |
| ***B65D 90/02*** | (2006.01) |
| ***B65D 90/24*** | (2006.01) |

(52) U.S. Cl.

CPC *B65D 90/26* (2013.01); *B67D 7/78* (2013.01); *B65D 90/028* (2013.01); *B65D 90/24* (2013.01)

USPC ..... 137/584; 137/143; 137/312; 137/391; 137/429; 137/557; 137/559; 137/590; 220/565; 220/567.2

(58) Field of Classification Search

USPC ..... 137/143, 312, 391, 409, 429, 557, 559, 137/584, 590, 590.5; 220/565, 567.2, 220/62.18; 200/84 R

See application file for complete search history.

(56) References Cited

U.S. PATENT DOCUMENTS

| | | | | |
|---|---|---|---|---|
| 2,252,173 | A * | 8/1941 | Lowell | 137/208 |
| 2,563,118 | A * | 8/1951 | Jackson | 220/560.03 |
| 2,810,036 | A * | 10/1957 | Mejean | 200/84 R |
| 3,608,768 | A | 9/1971 | McGrath | |
| 4,019,583 | A | 4/1977 | Simon | |
| 4,131,785 | A | 12/1978 | Shutt | |
| 4,519,415 | A | 5/1985 | Carn | |
| 4,605,038 | A * | 8/1986 | Tchitdjian | 137/429 |
| 4,803,343 | A | 2/1989 | Sotani et al. | |

(Continued)

FOREIGN PATENT DOCUMENTS

| | | |
|---|---|---|
| CA | 2169126 | 8/1997 |
| CA | 2196842 | 12/2000 |

(Continued)

*Primary Examiner* — John Rivell
(74) *Attorney, Agent, or Firm* — Bennett Jones LLP

(57) ABSTRACT

A double-walled above-ground storage tank includes a primary tank and a secondary tank, and an interstitial space; an containment chamber formed by a primary chamber wall and a secondary chamber wall, forming a chamber interstitial space therebetween, and an exterior door assembly; and at least one pipe and valve assembly wherein the pipe originates in the tank interior volume and the valve is disposed within the chamber.

6 Claims, 17 Drawing Sheets

(56) References Cited

U.S. PATENT DOCUMENTS

| | | | |
|---|---|---|---|
| 5,038,456 | A | 8/1991 | McGarvey |
| 5,071,166 | A | 12/1991 | Marino |
| 5,139,390 | A | 8/1992 | Rajewski |
| 5,154,312 | A | 10/1992 | Robbins |
| 5,197,627 | A | 3/1993 | Disabato et al. |
| 5,259,895 | A | 11/1993 | Sharp |
| 5,381,923 | A | 1/1995 | O'Dea |
| 5,960,826 | A | 10/1999 | Hebblethwaite et al. |
| 5,971,009 | A | 10/1999 | Schuetz et al. |
| 6,318,581 | B1 | 11/2001 | Garton |
| 6,516,754 | B2 | 2/2003 | Chadwick |
| 7,165,572 | B2 | 1/2007 | Hebblethwaite |
| 7,314,058 | B2 | 1/2008 | Saito |
| 8,328,040 | B2 * | 12/2012 | Ries ..... 220/562 |
| 8,418,718 | B2 | 4/2013 | Hebblethwaite |

FOREIGN PATENT DOCUMENTS

| | | |
|---|---|---|
| CA | 2609642 | 5/2009 |
| CA | 2675482 | 2/2011 |
| WO | 2011/035429 | 3/2011 |
| WO | 2011/069260 | 6/2011 |

* cited by examiner

DOUBLE WALLED TANKS WITH INTERNAL CONTAINMENT CHAMBERS

CROSS REFERENCE TO RELATED APPLICATIONS

This application is a continuation-in-part of U.S. patent application Ser. No. 12/887,151 filed on Sep. 21, 2010, now U.S. Pat. No. 8,418,718 the contents of which are incorporated herein by reference.

FIELD OF INVENTION

The present invention is directed to double walled storage tanks with internal containment chambers.

BACKGROUND

The storage of materials, including petroleum products and waste materials, in the upstream petroleum industry is dependent on primary containment devices, such as underground and aboveground storage tanks. Such tanks typically include secondary containment measures, which are required in some jurisdictions.

In Alberta, a single-walled above-ground storage tank must have secondary containment consisting of a dike with an impervious liner. However, the regulations permit the use of double-walled above-ground storage tanks ("DW ASTs") as an alternative to single-walled above-ground tanks and a secondary containment system. However, it has been found that DW ASTs are typically configured with manways and piping through the walls of the tanks. A majority of spills or releases from tanks are the result of operational issues such as overfilling, leaks and drips from valves and fittings, and spillage associated with fluid transfer. These releases are not being contained by the double-wall interstitial space.

The use of an internal containment chamber within single walled tanks is known. Applicant's CA Patent No. 2,196,842 and U.S. Pat. No. 5,960,826 disclose the use of such containment chambers to contain spills and overflows from various valves used in these tanks.

SUMMARY OF THE INVENTION

In one aspect, the invention comprises an above-ground storage tank comprising:

(a) a tank roof, a tank floor, a primary tank and a secondary tank, which together define a tank interstitial space therebetween;

(b) a containment chamber formed by a primary chamber wall and a secondary chamber wall, which together define a chamber interstitial space therebetween, and an exterior door assembly;

(c) wherein the primary tank, the primary chamber wall and the tank floor together define a tank interior volume;

(c) at least one pipe and valve assembly wherein the pipe originates in the tank interior volume and the valve is disposed within the chamber;

(d) wherein the at least one pipe and valve assembly does not pass through the primary tank or the primary chamber wall in a non-freeboard zone.

In one embodiment, the at least one pipe and valve assembly passes into the chamber without passing through the primary tank at all, or passes through the primary tank in a freeboard zone and into the containment chamber from the tank interstitial space, or passes through the primary and secondary tank in a freeboard zone and into the chamber through the exterior door assembly.

The configuration of the containment chamber and the at least one pipe and valve assembly is arranged such that the double-walled protection of the tank is not compromised by any pipe or hatch or other opening, except in the freeboard zone.

In another aspect, the invention may comprise a double-walled above-ground storage tank comprising:

(a) a tank roof, a tank floor, a primary tank and a secondary tank, which together define a tank interstitial space therebetween, wherein the primary tank and the tank floor together define a tank interior volume;

(b) a main containment chamber formed by a chamber wall;

(c) an ancillary containment chamber formed by an ancillary chamber wall, wherein the ancillary containment chamber is above and contains the main containment chamber, and both the main and ancillary containment chambers are disposed within the tank interior volume; and (d) a high level shutdown pipe which extends between a freeboard portion of the tank interior volume and the main containment chamber, passing through the ancillary containment chamber, and comprising a high level shutdown valve disposed within the main containment chamber, wherein the high level shutdown valve comprises a fluid sensor and a switch operative to stop inflow into the tank, or signal an alarm, or both.

BRIEF DESCRIPTION OF THE DRAWINGS

In the drawings, like elements are assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention. The drawings are briefly described as follows.

DETAILED DESCRIPTION OF PREFERRED EMBODIMENTS

The invention relates to double-walled aboveground storage tanks. When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the spirit and scope of the invention, as defined in the appended claims.

In one embodiment, the invention comprises an above-ground storage tank defining an interior volume and having an internal containment chamber. The tank itself is double-walled, as is the containment chamber. All pipe and valve assemblies which penetrate into the tank are configured so as to not compromise either the interstitial space of the tank or the containment chamber. In one embodiment, the interstitial space of the tank is not compromised because the primary tank is not penetrated, or is only penetrated in the freeboard zone of the tank. As used herein, the term "freeboard" means that area of the tank above the highest fluid level of the tank, or an area which is normally not in contact with fluid in the tank.

Therefore, in one embodiment, the invention comprises an above-ground storage tank comprising:

(a) a tank roof, a tank floor, a primary tank and a secondary tank, which together define a tank interstitial space therebetween;

(b) a containment chamber formed by a primary chamber wall and a secondary chamber wall, which together define a chamber interstitial space therebetween, and an exterior door assembly;

(c) wherein the primary tank, the primary chamber wall and the tank floor together define a tank interior volume (c) at least one pipe and valve assembly wherein the pipe originates in the tank interior volume and the valve is disposed within the chamber;

(d) wherein the at least one pipe and valve assembly does not pass through the primary tank or the primary chamber wall in a non-freeboard zone.

In one embodiment, the at least one pipe and valve assembly passes into the chamber without passing through the primary tank at all, or passes through the primary tank in a freeboard zone and into the containment chamber from the tank interstitial space, or passes through the primary and secondary tank in a freeboard zone and into the chamber through the exterior door assembly.

Figure 1:
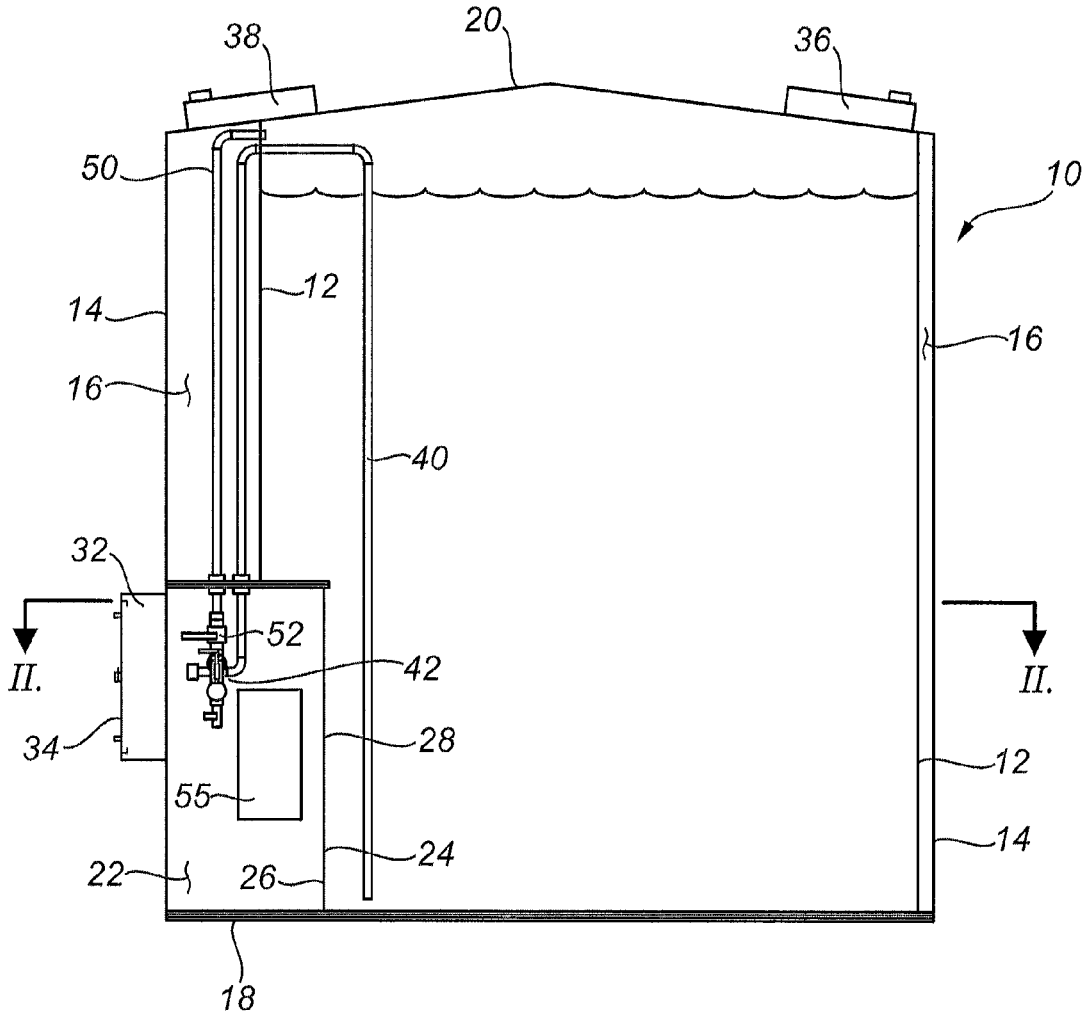
FIG. 1 shows a vertical cross-section through one embodiment of a tank of the present invention.
Figure 2:
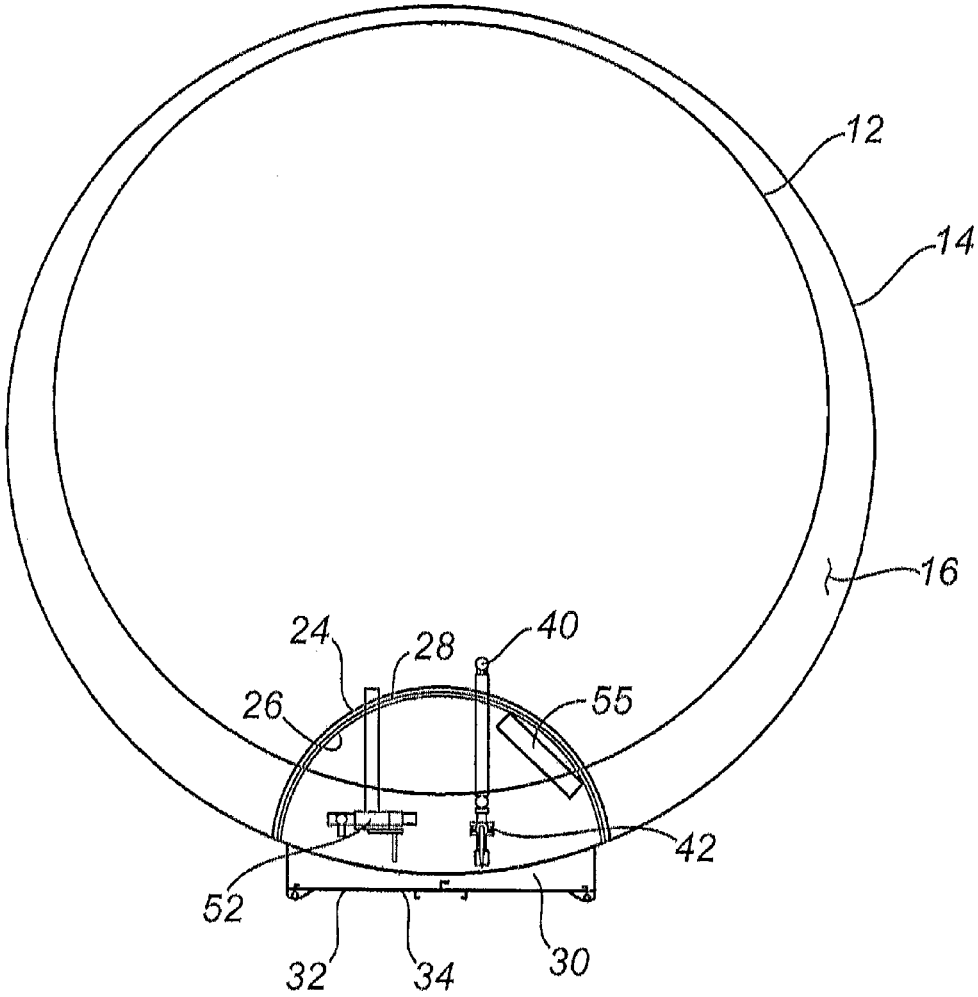
FIG. 2 shows a horizontal cross-section through the embodiment shown in FIG. 1, along line II-II.

As shown in FIGS. 1 and 2, in one embodiment, a storage tank (10) has an inner primary tank (12), and an outer secondary tank (14), which defines a tank interstitial space (16) therebetween. As required by regulation in Alberta, the floor (18) is also double-walled, while the roof (20) is not as it is considered part of the freeboard zone of the tank.

An internal containment chamber (22) is created by a chamber primary wall (24) and a chamber secondary wall (26), which together define a chamber interstitial space (28). The primary chamber wall (24) is that wall which faces the tank interior volume, while the secondary chamber wall (26) is that wall facing inside the chamber (22). The chamber walls (24, 26) are attached to the tank walls (12, 14) in a fluid-tight manner, such as by a suitable welding process. The attachments between the tank and containment chamber primary and secondary walls may be varied, as will be described below. What is essential is that the tank interstitial space and chamber interstitial space not be compromised.

Access to the containment chamber (22) is provided by a door assembly (30) which passes through the secondary tank wall (14). The door assembly may comprise a box (32) having a door (34). The door assembly can either be formed from the tank secondary wall material, or, be a completely separate manufactured component that is welded to the exterior of the tank secondary wall, over a door opening cut through both secondary and primary walls. The door opening must then be framed between the primary and secondary tank walls to re-seal the interstitial space. This doorway opening provides access into the containment chamber.

A tank access hatch (36) may be provided through the tank roof (20). A pipe access hatch (38) may be also be provided which provides access the interstitial space, tank volume or chamber space which houses pipe and valve assemblies, as described below.

The tank comprises at least one pipe and valve assembly. In one embodiment, the tank comprises two pipe and valve assemblies: a suckout pipe (40) and an overflow pipe (50). The suckout pipe (40) originates near the tank floor, rises to the freeboard zone (F), where it passes through the primary tank wall (12) and into the tank interstitial space (16). It then passes through the containment chamber walls and into the containment chamber, where it terminates with a suckout valve (42).

An overflow pipe (50) originates in the freeboard zone, near the fluid line marking maximum capacity of the tank, and passes into the tank interstitial space (16). The overflow pipe (50) then continues into the containment chamber, and terminates in a high level shutdown valve (52). This valve (52) may include sensors and switches connected to regulate inflows into the tank, and/or may be connected to transmitters (not shown) which transmit a wireless or radio alarm signal, as is well known in the art. If fluid in the tank exceeds the maximum capacity, a small amount of fluid will flow into the overflow pipe (50), and into the high level shutdown valve (52). Sensors in the valve may detect fluid, and cause inflows into the tank to stop. In another embodiment, there may be fluid connections from either or both the tank interstitial space or the chamber interstitial space to the high level shutdown valve. Accordingly, fluid in either interstitial space, which means that the primary tank or primary chamber wall has been breached, will cause an alarm signal or shutdown of inflows, or both.

As may be seen in FIGS. 1 and 2, both the suckout pipe (40) and valve (42) assembly and the overflow pipe (50) and valve (52) assembly do not compromise the integrity of the interstitial space, as they pass into the interstitial space in the freeboard zone, and then directly into the containment chamber, which is itself double-walled.

A heater (55) may be provided within the containment chamber to keep the valves (42, 52) from freezing in the winter.

Figure 3:
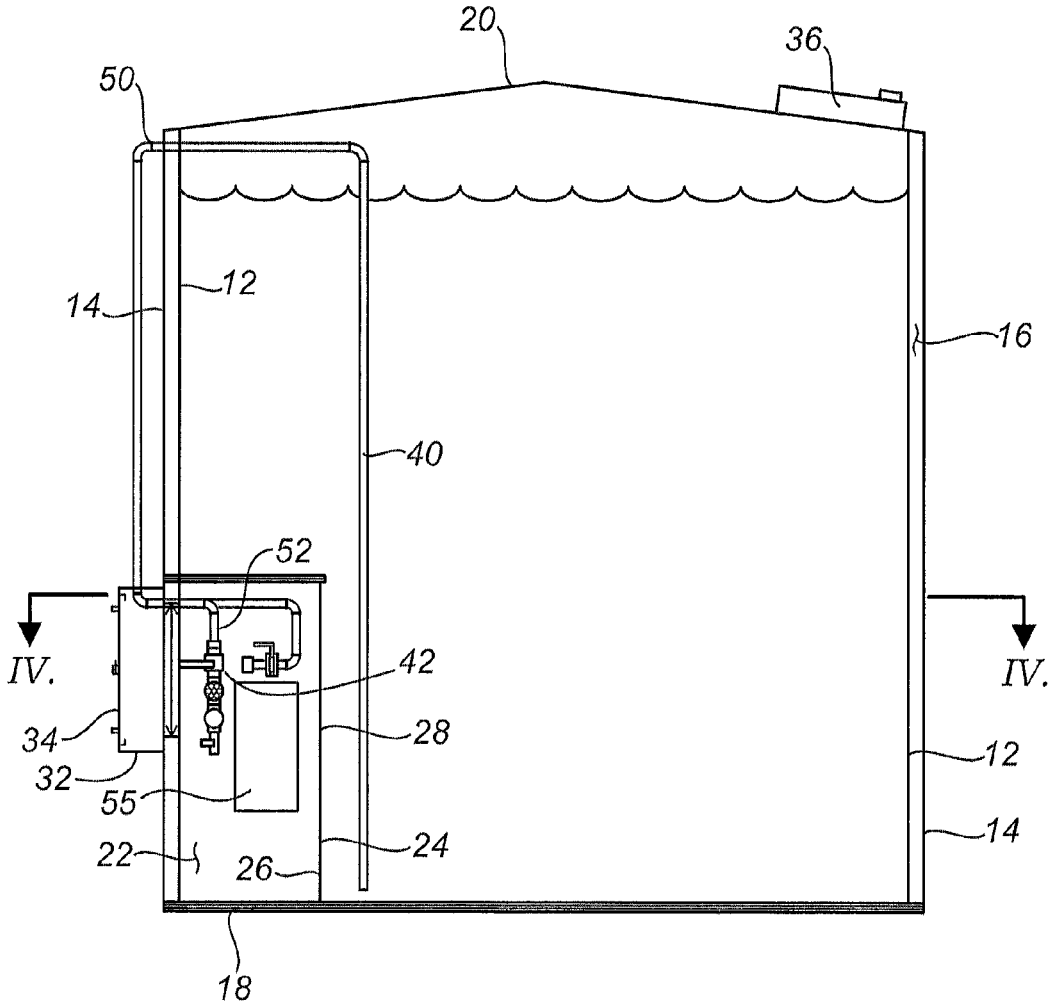
FIG. 3 shows a vertical cross-section through an alternative embodiment of a tank of the present invention.
Figure 4:
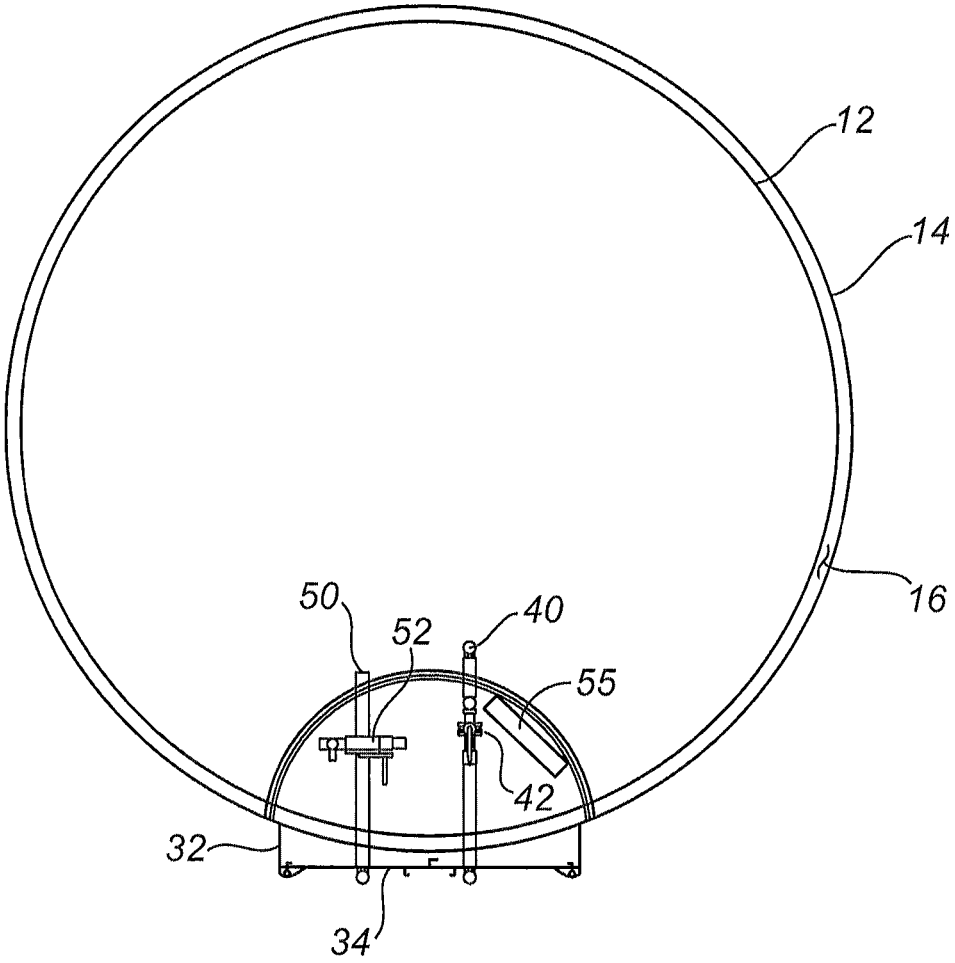
FIG. 4 shows a horizontal cross-section through the embodiment shown in FIG. 3, along line IV-IV.

In an alternative embodiment, as shown in FIGS. 3 and 4, the pipes (40, 50) pass through both the primary and secondary tank walls in the freeboard zone. The pipes then pass along the exterior of the tank, and enter into the containment chamber through the door box (32). Because the pipes are accessible on the exterior of the tank, in this embodiment, a pipe access hatch into the tank is not necessary.

Figure 5:
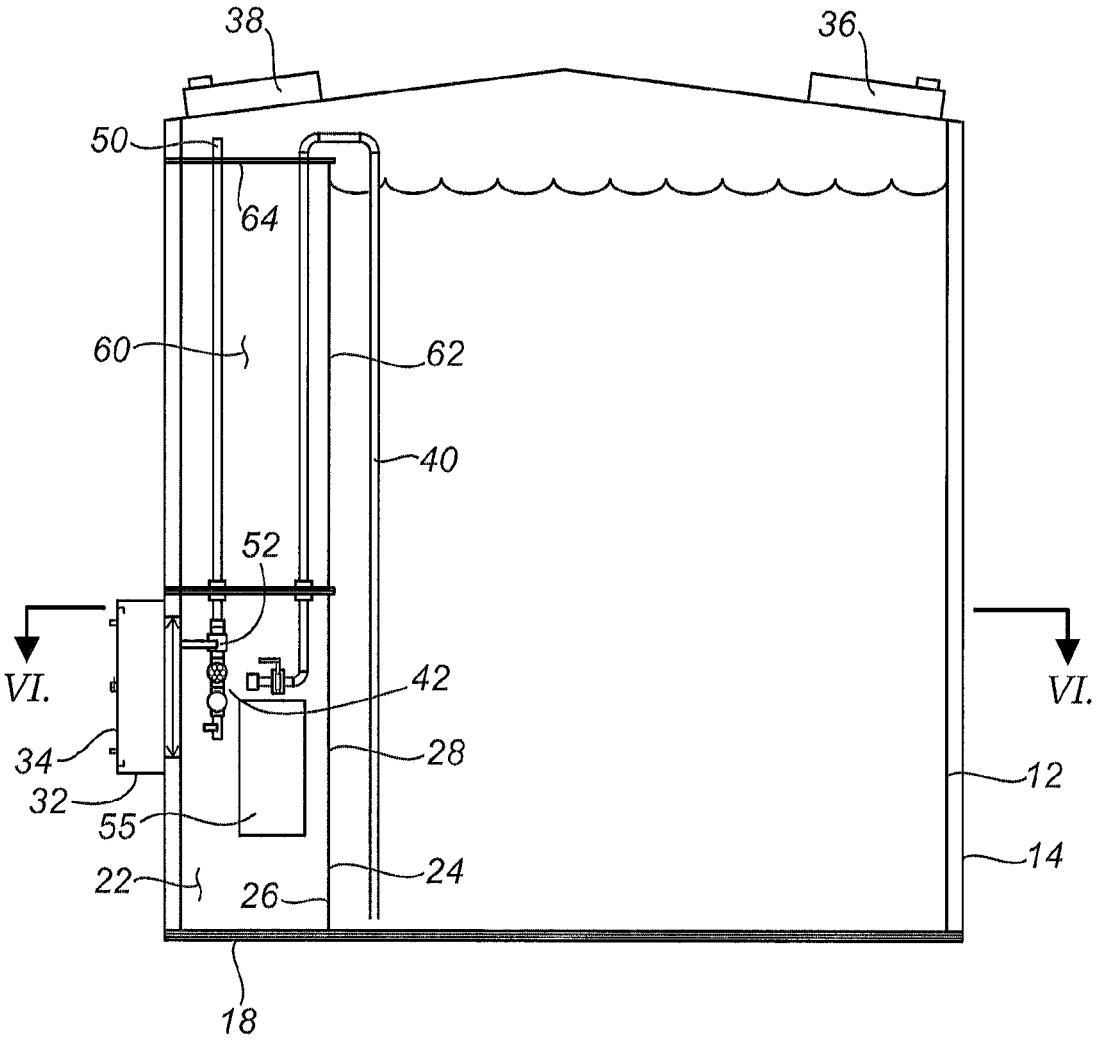
FIG. 5 shows a vertical cross-section through an alternative embodiment of a tank of the present invention.
Figure 6:
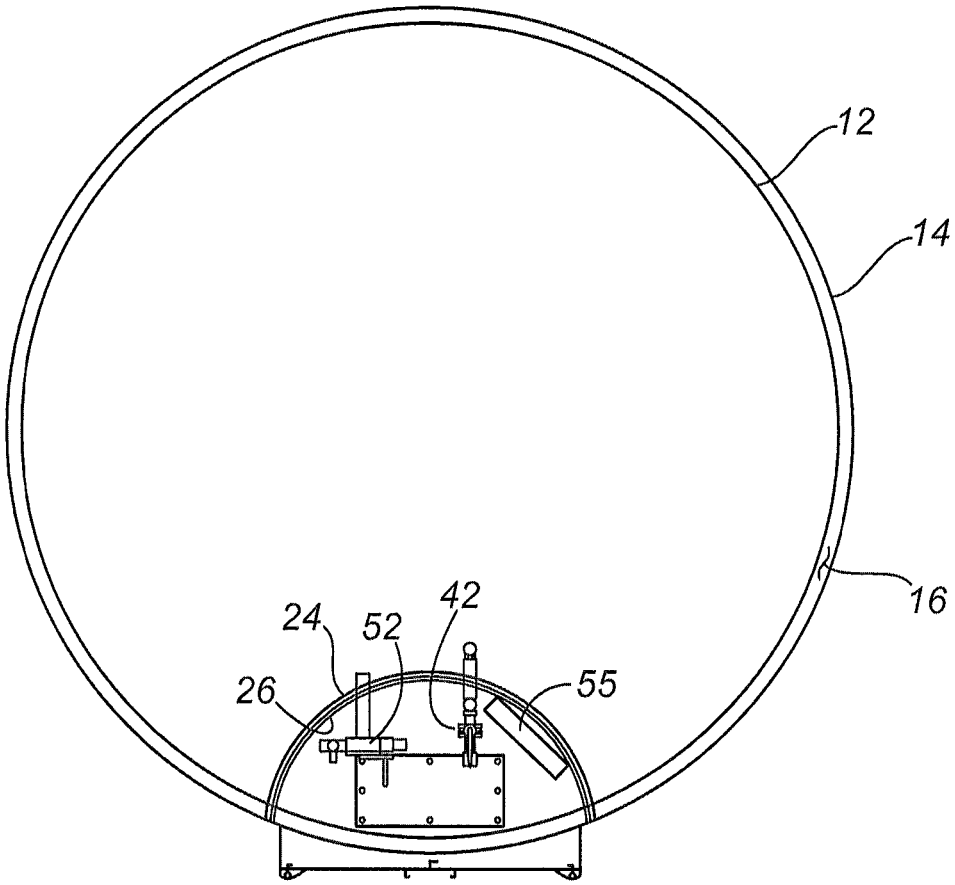
FIG. 6 shows a horizontal cross-section through the embodiment shown in FIG. 5, along line VI-VI.

In an alternative embodiment, shown in FIGS. 5 and 6, the tank comprises an ancillary containment chamber (60) formed by a single walled enclosure (62). The ancillary chamber is formed adjacent to the main containment chamber and has a roof portion (64). The pipes (40, 50) pass into the ancillary chamber, preferably but not necessarily in the freeboard zone, and from there, pass into the main containment chamber. The overflow pipe (50) simply extends up through the roof portion (64). Because the single walled enclosure is ancillary to the double walled tank and containment chamber, the incursions into the interstitial spaces are contained by the ancillary chamber.

Figure 7:
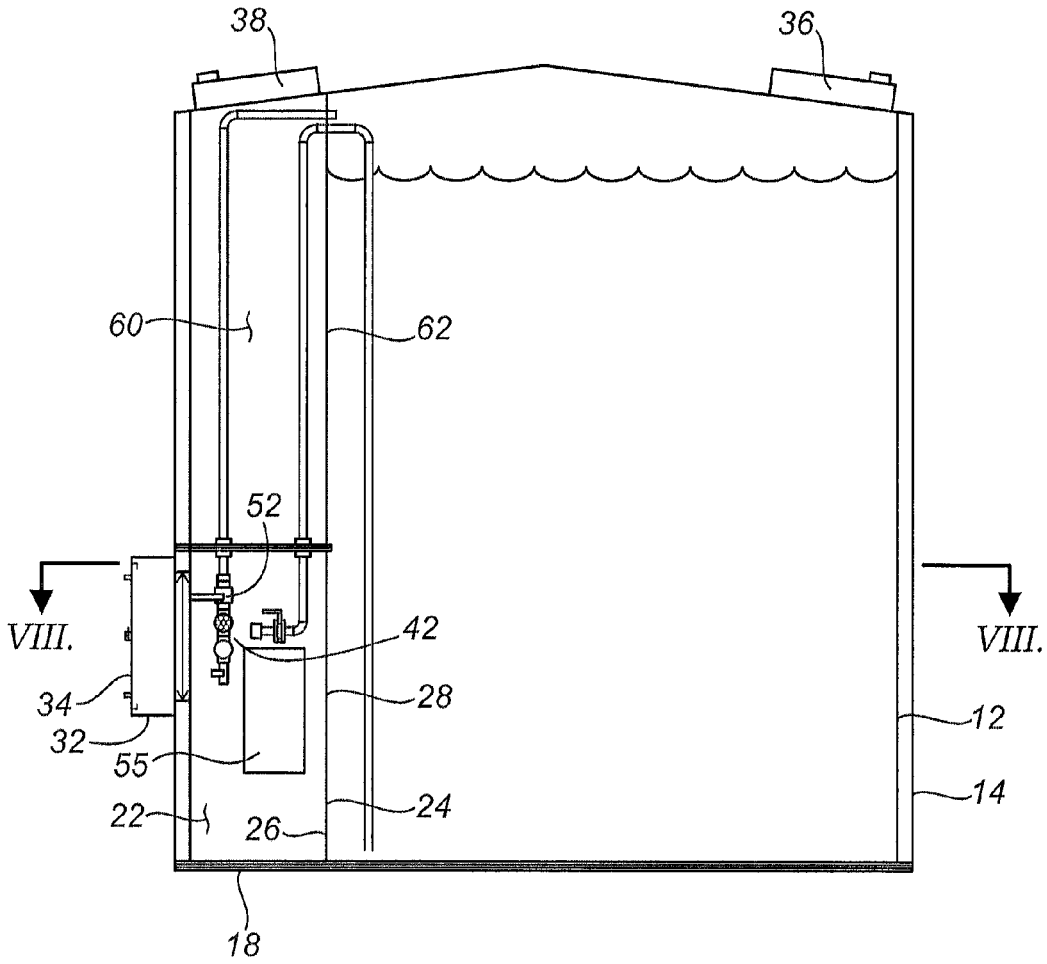
FIG. 7 shows a vertical cross-section through an alternative embodiment of a tank of the present invention.
Figure 8:
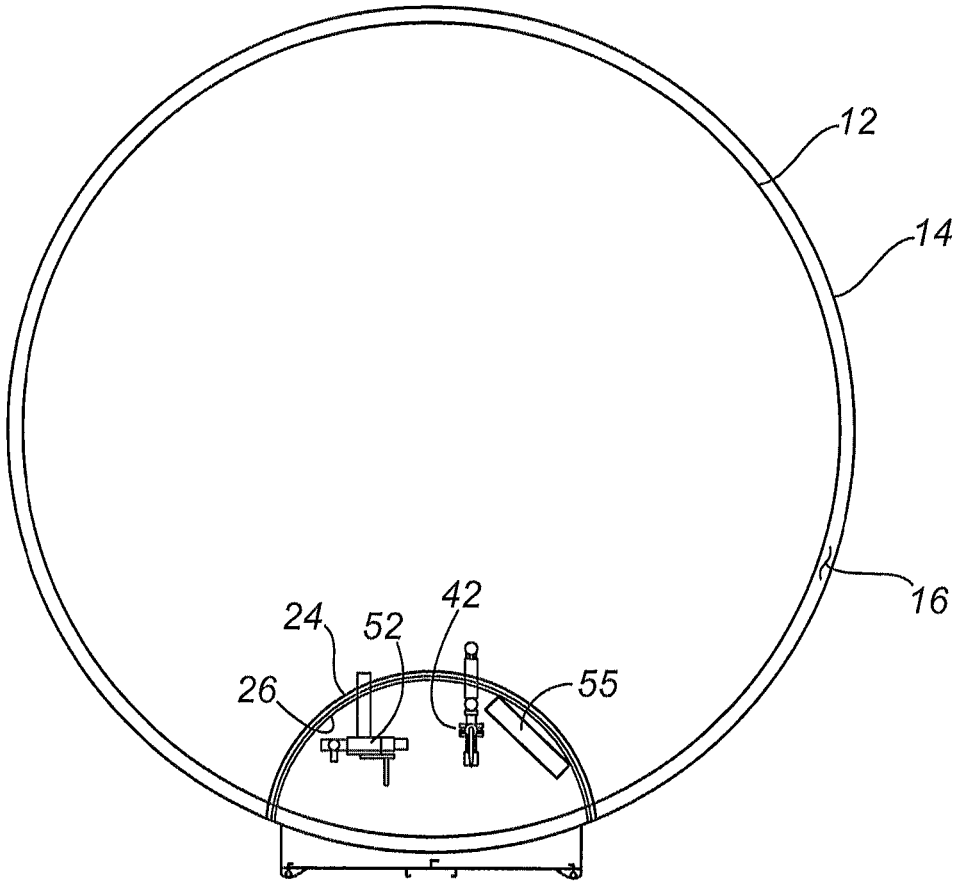
FIG. 8 shows a horizontal cross-section through the embodiment shown in FIG. 7, along line VIII-VIII.

In a further alternative embodiment, as shown in FIGS. 7 and 8, the single walled enclosure (62) of the ancillary chamber extends upwards and attaches to the tank roof (20). The access hatch (38) through the tank roof (20) provides direct access into the ancillary chamber, unlike the embodiment shown in FIGS. 5 and 6, where the pipe access hatch (38) only provides access to the roof portion (64) of the ancillary chamber.

Figure 9:
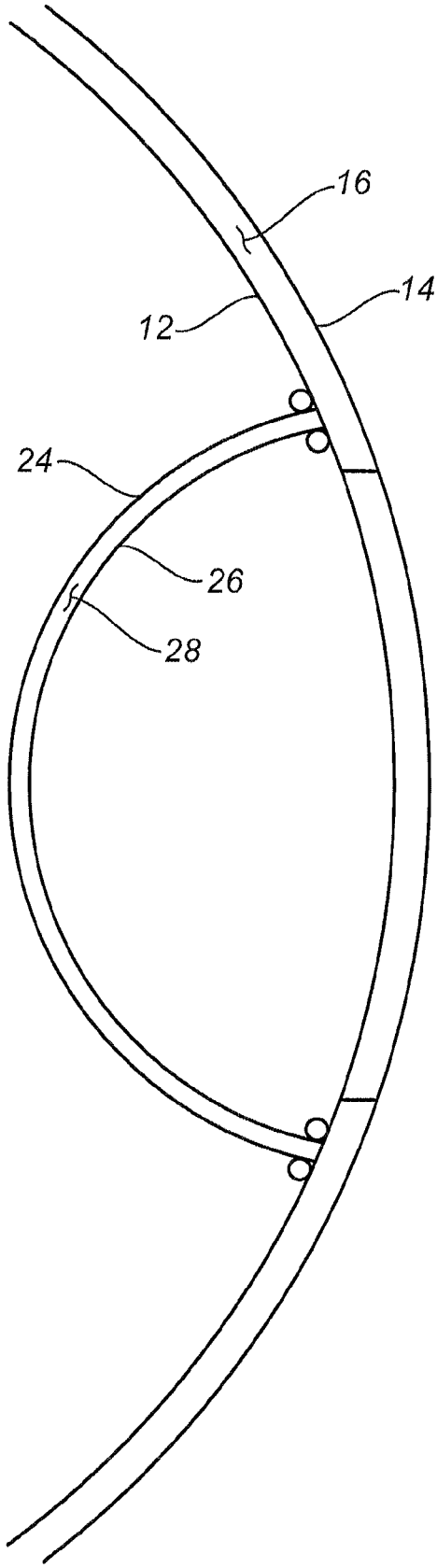
FIG. 9 shows one embodiment of the configuration of welds connecting the primary and secondary tank walls to the primary and secondary chamber walls.
Figure 10:
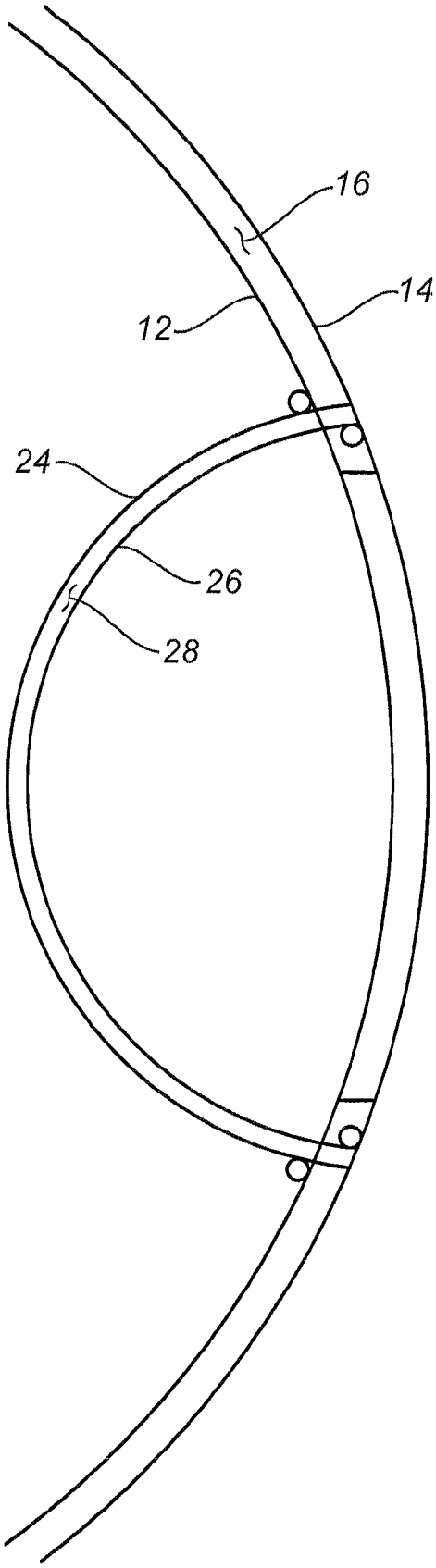
FIG. 10 shows an alternative embodiment of the configuration of welds connecting the primary and secondary tank walls to the primary and secondary chamber walls.
Figure 11:
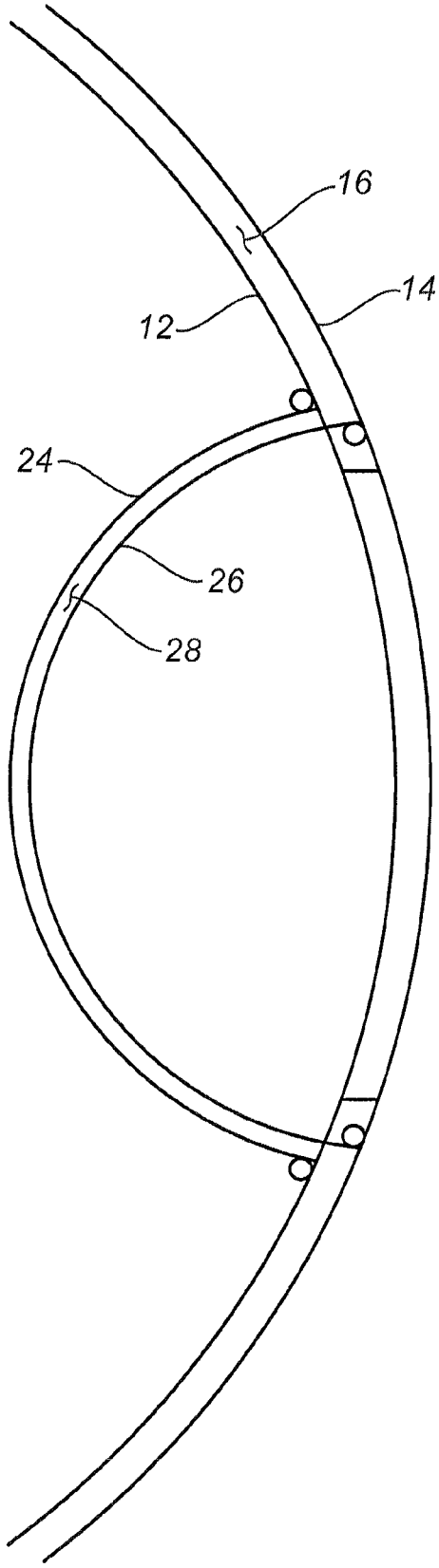
FIG. 11 shows an alternative embodiment of the configuration of welds connecting the primary and secondary tank walls to the primary and secondary chamber walls.

As shown in FIGS. 9, 10 and 11, various configurations of attachment between the tank primary and secondary walls and the chamber primary and secondary walls are possible. Both of the primary or secondary chamber walls (24, 26) may attach to the primary tank wall, as is shown in FIG. 9. In this case, the tank interstitial space and the chamber interstitial space are separated by the primary tank wall. In one embodiment, the attachment is accomplished by a full penetration weld (W) which is fluid-tight.

Alternatively, the primary chamber wall (24) may attach to the primary tank wall (12), while secondary chamber wall (26) attaches to the secondary tank wall (14). In one embodiment, shown in FIG. 10, the primary chamber wall is welded to the primary tank wall in a fluid tight manner, and the secondary chamber wall is welded to the secondary tank wall. As a result, the tank interstitial space (16) is contiguous with the chamber interstitial space (FIG. 11). Alternatively, there is no sealed connection between the two (FIG. 10), which means the two interstitial spaces are connected but not contiguous.

Figure 12:
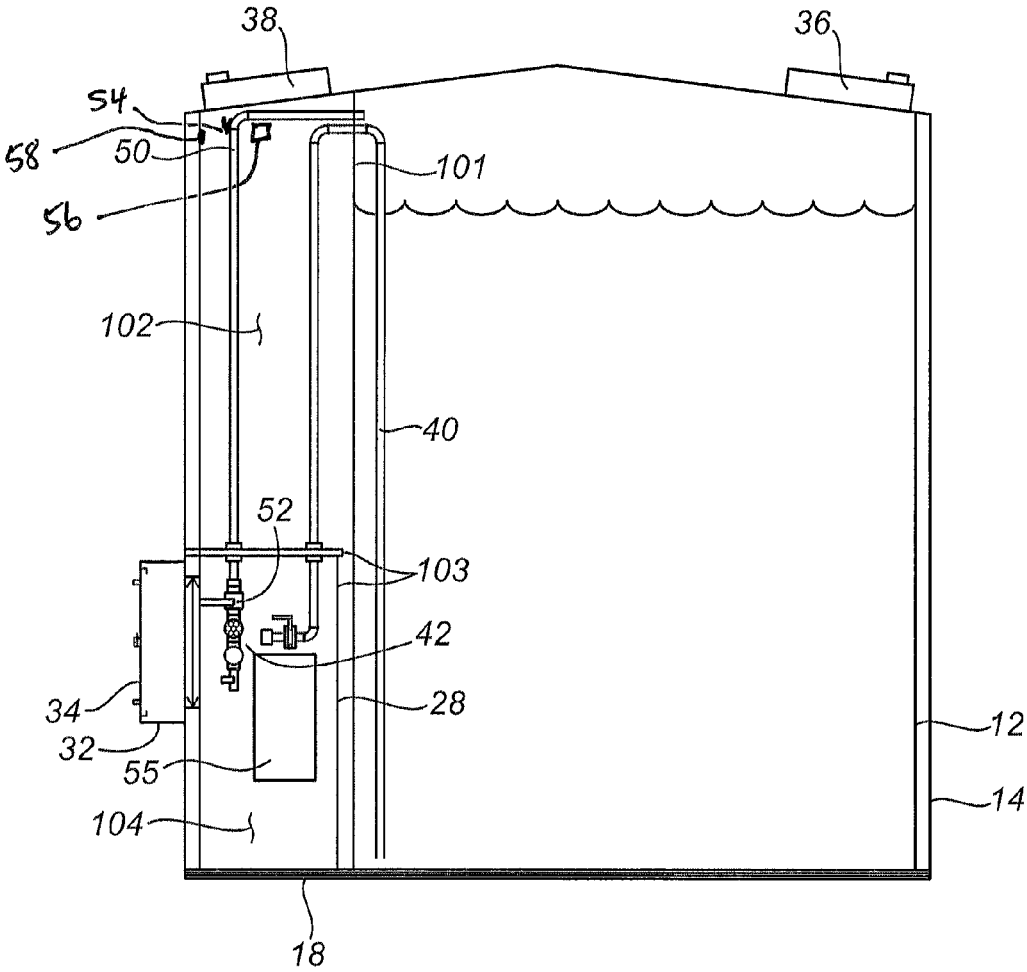
FIG. 12 shows a vertical cross-section through an alternative embodiment of a tank of the present invention.
Figure 14:
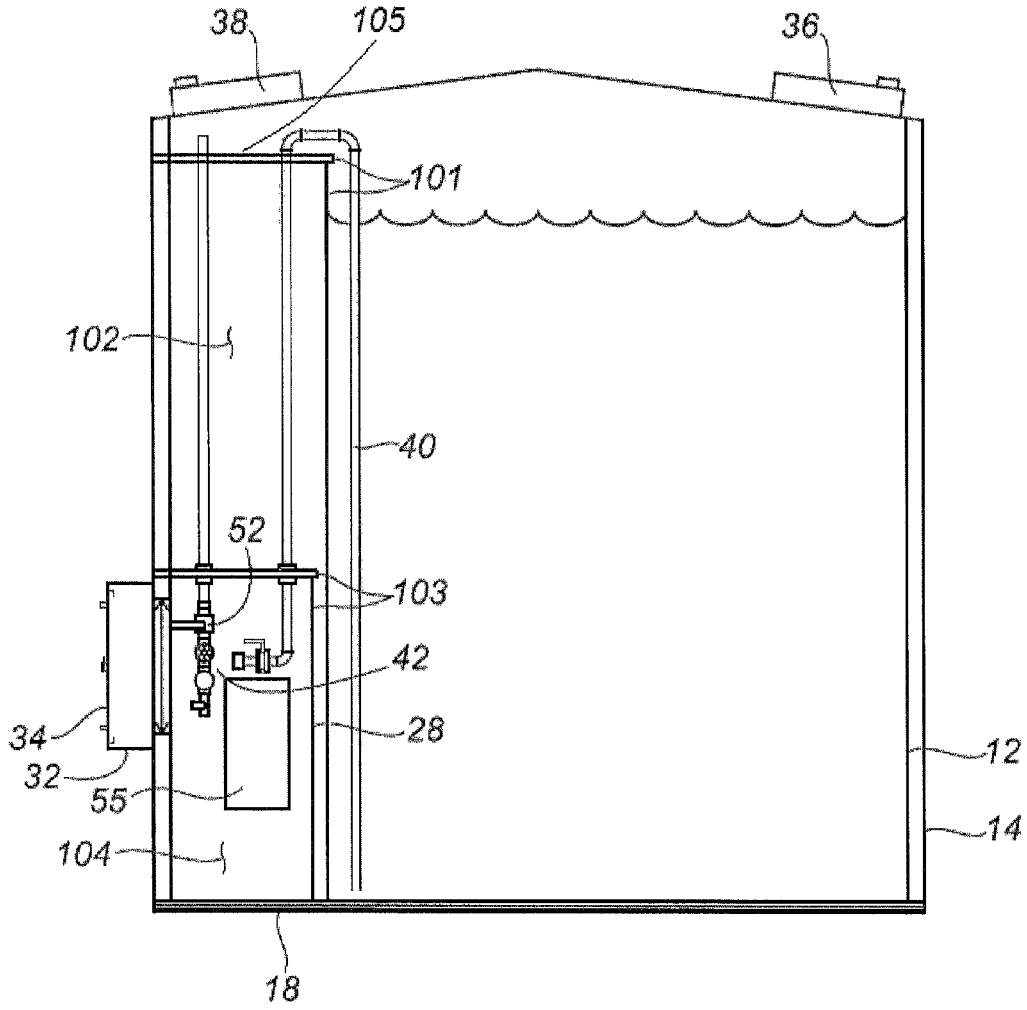
FIG. 14 shows a vertical cross-section through an alternative embodiment of a tank of the present invention.

In an alternative embodiment, two single walled chambers may be used in place of a dual-walled chamber. This implementation may provide more convenient installation or retrofitting possibilities in some cases. As shown in FIG. 12, a primary chamber wall (101) is installed so as to surround a secondary chamber wall (103) and extends all the way to the tank roof. The pipes (40, 50) pass through the primary chamber wall (101) and into an ancillary chamber (102) and then into the lower containment chamber (104) through the secondary chamber wall (103). Preferably, the pipes (40, 50) pass through the primary chamber wall (101) in the freeboard zone. Thus, the ancillary chamber (102) created between the first and second chamber walls (101, 103) provides the equivalent of an interstitial space and may contain any spills or leaks from the tank and from the pipe fittings, while the lower chamber (104) corresponds to the containment chamber (22) in the embodiments described above. In one variation, the first single walled chamber (101) does not extend all the way to the roof, only to the freeboard zone of the tank. The chamber thus has a roof section (105) through which the pipes (40, 50) may pass, as shown in FIGS. 14.

Embodiments which provide an ancillary and a lower containment chamber allows tank overflow protection into ancillary containment chambers. For example, an overflow valve (54) may be provided on the overflow pipe (50), preferably near an upper section of the pipe. The overflow valve (54) is normally closed, however, if fluid enters the overflow pipe up to the level of the overflow valve (54), then the overflow valve (54) allows the fluid to enter and be contained within the ancillary chamber (102). In one embodiment, the overflow valve (54) is a simple flapper valve located on the elbow joint of the overflow pipe (50).

Further redundant overflow protection may be installed. A backup high level shutdown sensor and switch (56) installed near the top or roof of the ancillary chamber may detect fluid in the ancillary chamber (104), and operate to stop inflow into the tank by connection with an intake valve, or to signal an alarm, or both. Further, in one embodiment, an opening (58) through the primary tank wall within the ancillary chamber (104) allows overflow of fluid into the tank interstitial space. This overflow protection will only be necessary if all other high level shutdown sensors and switches have failed, and the ancillary chamber has filled to the top, where the opening (58) exists. Therefore, in one embodiment, the tank interstitial space provides the final overflow protection.

Figure 16:
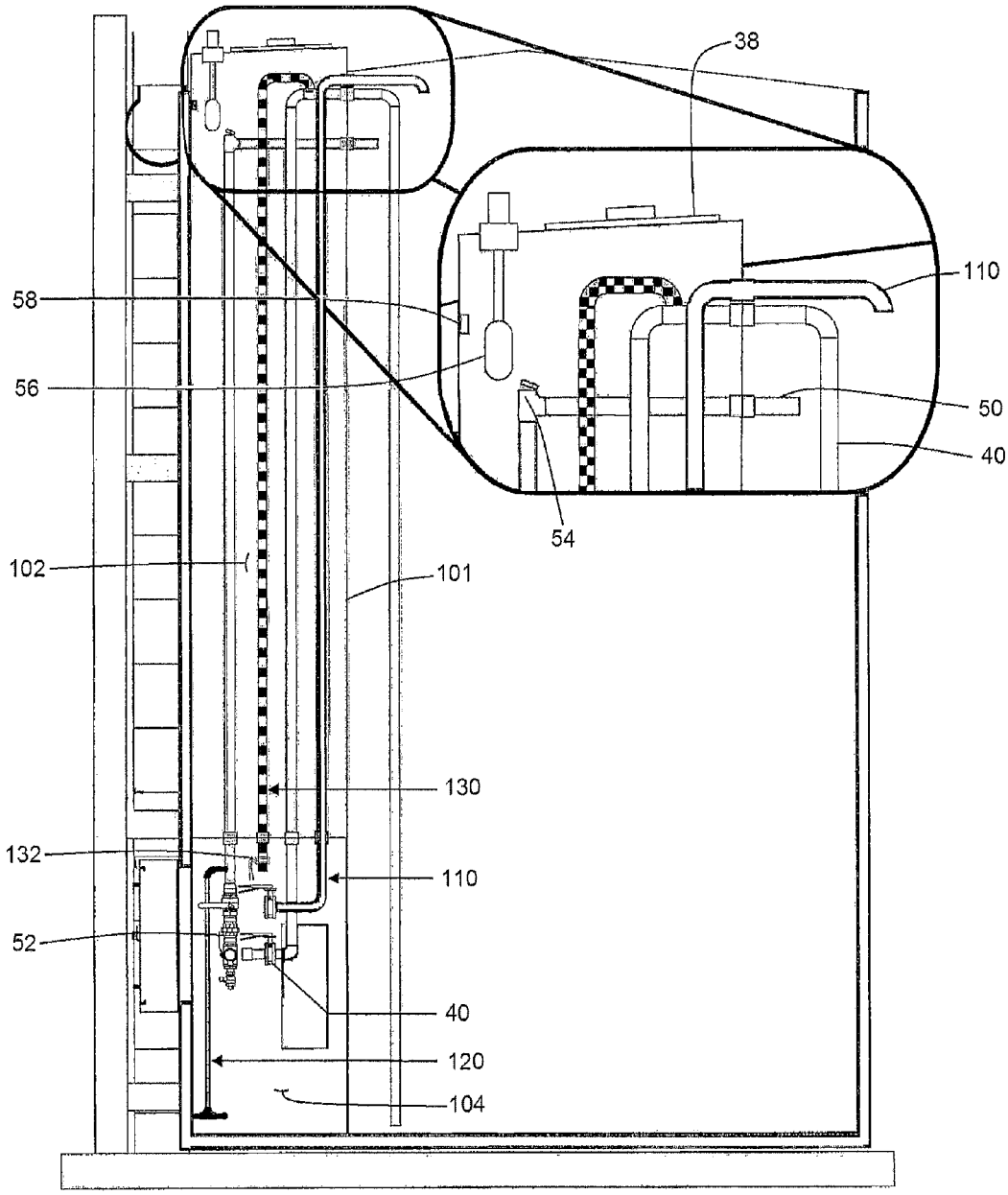
FIG. 16 shows a vertical cross-section through an alternative embodiment of a tank of the present invention.
Figure 17:
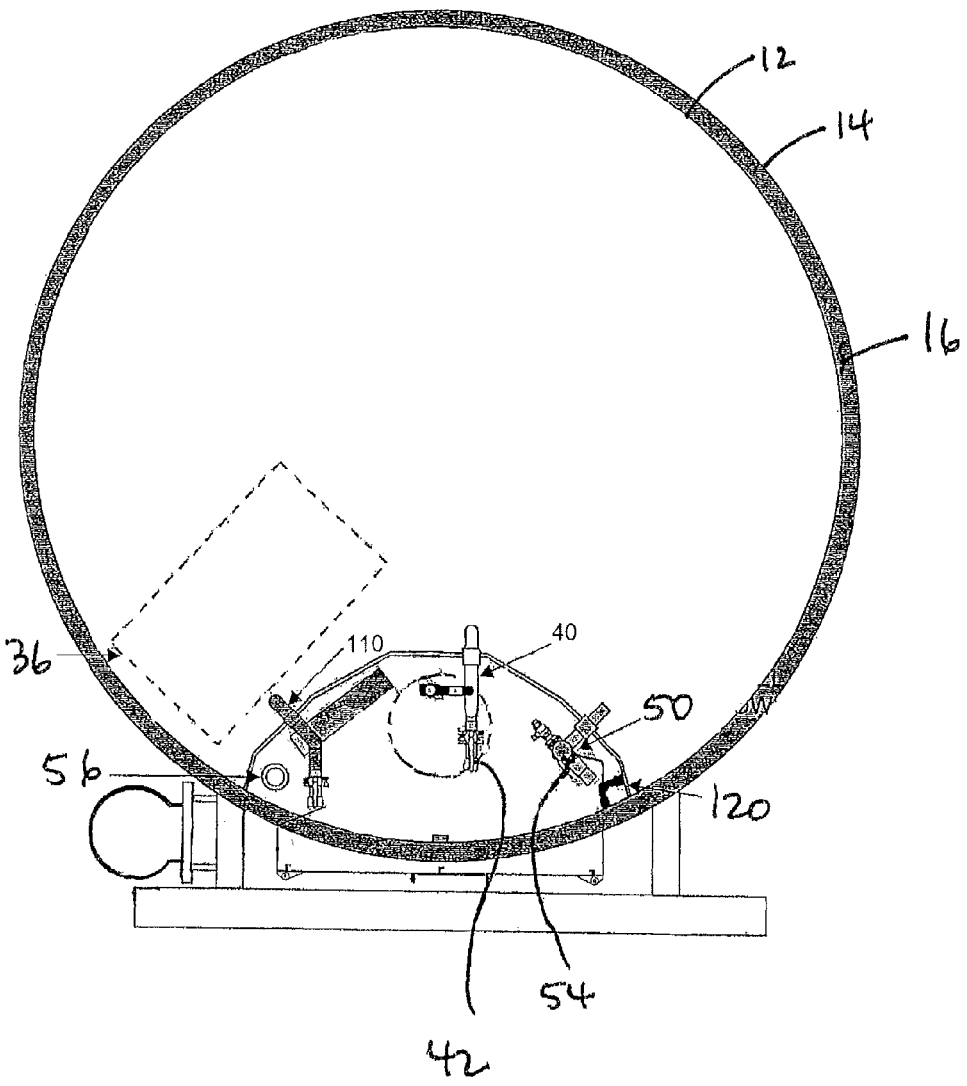
FIG. 17 shows a horizontal cross-section through the embodiment shown in FIG. 9, along line XVII-XVII.

In a further alternative, the primary chamber wall (101) extends up through the tank roof, with an access hatch as shown in FIGS. 16 and 17. Additional features are shown in this example, which may also be included with any embodiment of the invention. An inlet pipe (110) passes through the chamber door into the chamber, upwards through the secondary chamber wall (103), and finally into the tank through the primary chamber wall (12) in the freeboard zone. An overflow pipe (50) connects to a high level shut down valve (52) as described above.

A suck out pipe (40) and valve (42) may also provided as described above. In one embodiment, a siphon break (130) is connected to the suck out pipe (30) and terminates with a siphon valve (132) in the containment chamber.

Figure 13:
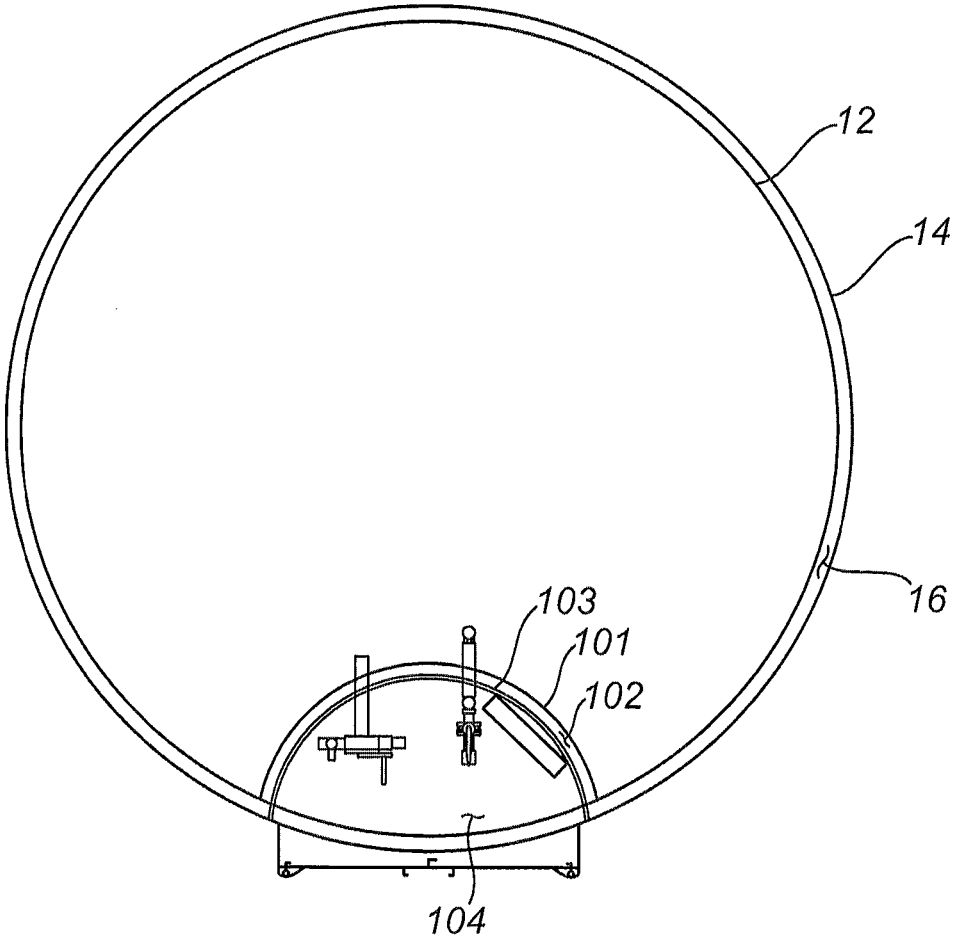
FIG. 13 shows a horizontal cross-section through the embodiment shown in FIG. 12, along line XIII.
Figure 15:
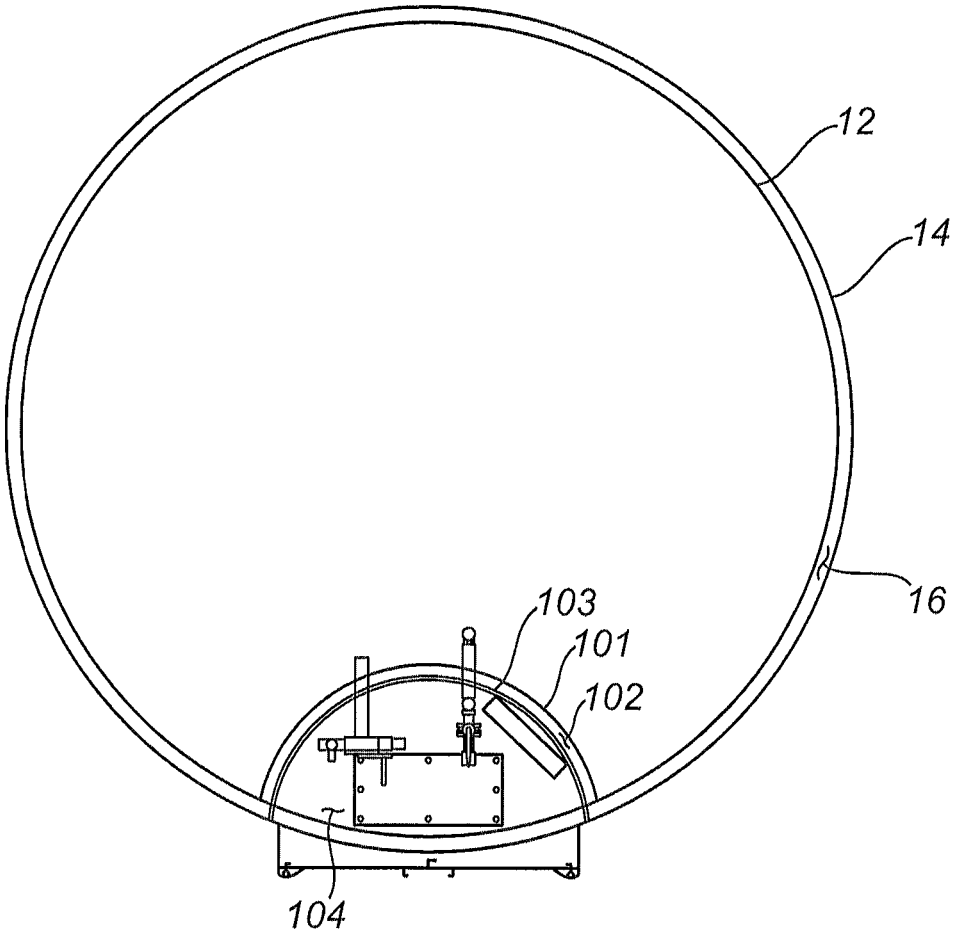
FIG. 15 shows a horizontal cross-section through the embodiment shown in FIG. 14, along line XV.

As shown in FIGS. 13 and 15, the primary chamber wall (101) may be welded to the primary tank wall, while the secondary chamber wall (103) may be welded to the secondary tank wall. Alternatively, both primary and secondary chamber walls may be welded to the primary tank, as shown in FIG. 17. The same variations of welding patterns described above may apply to these embodiments. As may be appreciated by those skilled in the art, an existing double walled tank having a single walled containment chamber may be easily retrofitted with a primary chamber wall. The first single walled chamber may be welded into the tank in sections to facilitate installation. For example, a lower piece and an upper piece may be installed, leaving a middle section open to allow access to the containment chamber and tank interior. Once all welds have been finished and all piping installed, then a middle piece or pieces may be installed to complete the primary chamber wall.

In one embodiment, the tank comprises fluid detection sensors (not shown) in the tank interstitial space, the chamber interstitial space, or both. If the tank interstitial space, and the chamber interstitial space are connected or contiguous, it may possible to implement only one fluid detection sensor within either the tank or the chamber interstitial space. Suitable fluid detection sensors are well known in the art. In one embodiment, an interstitial connect (120) may be provided which provides a fluid connection between either or both of the tank interstitial space and the chamber interstitial space and the high level shut down valve (52). The interstitial connect (120) may be transparent or translucent to enable visual confirmation of fluid in the connect (120). The bottom end of the connect may terminate in a "Y" connector (122) to connect both the tank and chamber interstitial spaces. The interstitial connect (120) may incorporate one-way valves to prevent fluid the overflow pipe (50) from entering the interstitial space.

As will be apparent to those skilled in the art, various modifications, adaptations and variations of the foregoing specific disclosure can be made without departing from the scope of the invention claimed herein.

What is claimed is:

1. A double-walled above-ground storage tank comprising:

(a) a tank roof, a tank floor, a primary tank and a secondary tank, which together define a tank interstitial space therebetween, wherein the primary tank and the tank floor together define a tank interior volume;

(b) a main containment chamber formed by a chamber wall;

(c) an ancillary containment chamber formed by an ancillary chamber wall, wherein the ancillary containment chamber is above and contains the main containment chamber, and both the main and ancillary containment chambers are disposed within the tank interior volume;

(d) a high level shutdown pipe which extends between a freeboard portion of the tank interior volume and the main containment chamber, passing through the ancillary containment chamber, and comprising a high level shutdown valve disposed within the main containment chamber, wherein the high level shutdown valve comprises a fluid sensor and a switch operative to stop inflow into the tank, or signal an alarm or both.

2. The tank of claim 1, wherein the ancillary chamber wall extends from the tank floor to the tank roof.

3. The tank of claim 1 wherein the high level shutdown pipe comprises an overflow valve which allows fluid into the ancillary containment chamber.

4. The tank of claim 3 wherein the primary tank defines an overflow opening providing fluid communication between the ancillary chamber and the tank interstitial space, the opening positioned at or near the top of the ancillary chamber.

5. The tank of claim 4 further comprising an interstitial connect disposed within the chamber, providing a fluid connection between the tank interstitial space or the chamber interstitial space, or both, and the high level shut down valve.

6. The tank of claim 5 wherein the interstitial connect is transparent or translucent to allow visual confirmation of the presence of absence of fluid in the interstitial connect.

* * * * *